United States Patent [19]

LaGrow

[11] Patent Number: 4,488,723

[45] Date of Patent: Dec. 18, 1984

[54] RECREATIONAL DEVICE FOR IMPELLING AN OBJECT

[76] Inventor: Alfred C. LaGrow, 3615 N. Harvard Ave., Peoria, Ill. 61614

[21] Appl. No.: 421,997

[22] Filed: Sep. 23, 1982

[51] Int. Cl.[3] ..... A63B 71/00

[52] U.S. Cl. ..... 273/129 T; 273/129 W

[58] Field of Search ..... 273/129 R, 129 L, 129 K, 273/129 M, 129 P, 129 Q, 129 AP, 129 S, 129 T, 129 V, 129 W, 87.2, 87.4, 68; 124/79; 214/82

[56] References Cited

U.S. PATENT DOCUMENTS

| | | | |
|---|---|---|---|
| 990,098 | 4/1911 | Black | 273/68 |
| 2,616,578 | 11/1952 | Dunham | 214/82 |
| 2,694,575 | 11/1954 | Paulson | 273/129 T |
| 2,719,716 | 10/1955 | Sawtelle | 273/129 V |
| 3,091,465 | 5/1963 | Ogdon | 273/129 |

*Primary Examiner*—Richard C. Pinkham
*Assistant Examiner*—Matthew L. Schneider

[57] ABSTRACT

A recreational device 10 for impelling an object comprises a generally upright shaft 12 having a lower end 20 and an intermediate part 22; a lever arm 14 having a heel portion 40 and an upper actuation portion 42 pivotally connected to the lower end 20 of the shaft 12; a stabilizing link 24 pivotally connected to the intermediate part 22 of the shaft 12, and a linkage assembly 32 for urging the object forwardly in response to downward movement of the shaft 12, the reaction of the heel portion 40 against a surface, and the forwardly and downwardly swinging of the lever arm 14.

11 Claims, 7 Drawing Figures

D1
D2

RECREATIONAL DEVICE FOR IMPELLING AN OBJECT

TECHNICAL FIELD

This invention relates to a device for impelling balls and other movable surface objects about for competitive scoring purposes such as done generally in indoor recreational activities and in games of skill.

BACKGROUND ART

U.S. Pat. No. 3,091,465 issued to E. B. Ogdon on May 28, 1963 teaches a ball impelling device incorporating a paddle that pivots forwardly in response to downward movement of a telescoping shaft. While that device is simple in its construction the mechanical advantage of the involved lever arms is such as to greatly limit its effectiveness. Excessively high reaction forces, are experienced by certain working surfaces thereof and yet the paddle does not impell the ball with the desired amount of speed or energy.

DISCLOSURE OF THE INVENTION

In one aspect of the present invention the recreational device for impelling an object includes an upright shaft having a lower end and an intermediate part; a lever arm having a lower rear heel portion and an upper front actuating portion and being pivotally connected by a first coupling joint to the lower end of the shaft; a stabilizing link pivotally connected to the shaft above the lever arm and extending forwardly therefrom; and impelling means; pivotally connected to the stabilizing link and the lever arm for urging the object forwardly in response to downward movement of the shaft, the rolling engagement of the heel portion against a surface, and the forwardly and downwardly swinging movement of the actuation portion of the lever arm.

In a second embodiment auxiliary modified stabilizing links are provided to accommodate one or more supplemental scissor linkages which can be added to increase effective reach for the linkage of the impelling device.

BEST MODE FOR CARRYING OUT THE INVENTION

Figures 1, 2, 3, 6:
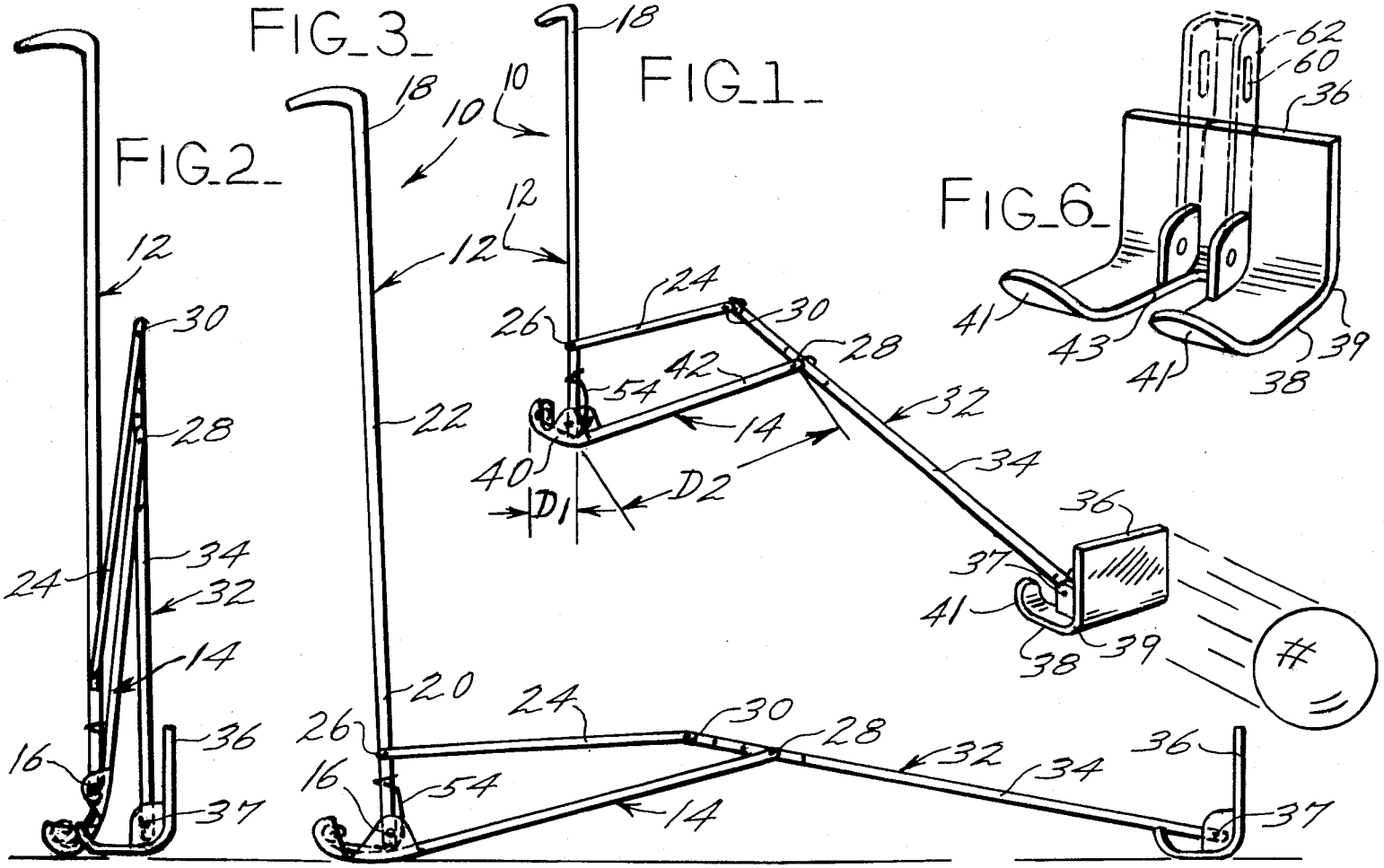
FIG. 1 is a diagrammatic perspective view of a first embodiment of the impelling device in a partially extended position.
FIG. 2 is a diagramatic side elevational view of the impelling device of FIG. 1 illustrating the disposition of the elements thereof in a retracted position.
FIG. 3 is a view similar to FIG. 2, but with the elements thereof disposed in a fully extended position.
FIG. 6 is a perspective view showing a retracted, close-nesting feature of the impacting shoe member.
Figure 5:
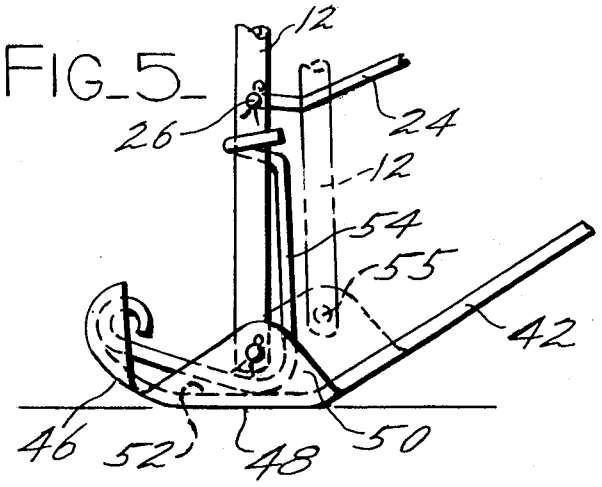
FIG. 5 is a similar view showing alternate pivot locations for members, and essential start/stop features of same.
Figure 4:
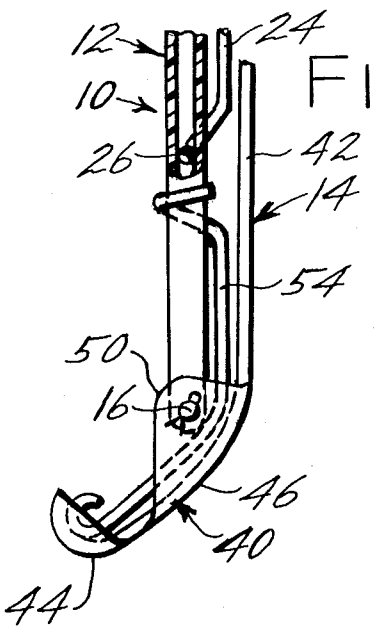
FIG. 4 is a fragmentary view of the fulcrum or heel portion located between and complementing the activating shaft and lever arm.

In a first embodiment of the invention, as disclosed in FIGS. 1 through 5, a recreational device designated 10 includes a generally upright shaft 12 and a lever arm 14 pivotally connected thereto at a coupling joint 16. Shaft 12 has an upper end 18, a lower end 20 and an intermediate part 22. A stabilizing element or link 24 is pivotally connected at its base or proximal end 26 to the intermediate part 22 of the shaft 12. Pivot joints 28 and 30 provided in the distal ends of arm 14 and link 24 respectively receive and functionly mount a linkage assembly 32 having a support arm 34 and an impact shoe 36. Shoe 36, adapted to the distal end of arm 34 by coupling means 37, includes a base or slide surface 38 having an upwardly curved leading edge 39 and an upwardly curved trailing edge 41. Shoe 36 also has a notched rear center portion 43 to allow maximum possible retraction of the linkage. Shoe 36 can be readily combined with little trouble as an integral part of arm 34 and fitted with an open-cell urethane pad (not shown) to assure good object contact and minimum surface friction or interference.

Referring specifically to lever arm 14 this composite structure is comprised of a lower heel portion 40 and an upper actuating portion 42. Heel portion 40 is located generally longitudinally rearwardly and elevationally below arm portion 42 and coupling joint 16. The heel 40 is designed to serve as a shifting or rolling fulcrum for lever arm 14 and is of a width capable of providing arm 14 adequate support under downward pressure from shaft 12. From its base 44 heel 40 can be fully arcuate as shown at 46 or can include a flattened surface 48. Surface 48 preferably is proximate two spaced ear-like projections 50 that form coupling joint 16. A small recess 52 within ear-like portions 50 and the arcuate base 44 of heel portion 40 serves to house a spring 54 which affords retraction means for arm 14 and its complementing linkage 32.

Since this recreational device 10 is readily adaptable for indoor use, a fully arcuate heel portion 40 will tend to cushion operation of the impelling device 10. Provision of flat surface 48 on heel 40 makes available an extension limiting means for arm 42 to minimize shock loading of coupling joints etc. Use of an alternative shaft coupling joint 55 shown in phantom lines (for coupling joint 16) allows upright shaft 12 to be connected to the lever arm 14 elevationally above the heel portion 40 and will maximize the forwardly and downwardly swinging movement of the lever activating portion 42 and complementing linkage 32.

The functional characteristics or response of the subject impelling device 10 is determined by the specific ratios used in forming heel portion 40 and arm portion 42 of lever arm 14, as well as the relative location of coupling joint 16 thereto. This relationship of joint locations and ratios will be described subsequently.

Figure 7:
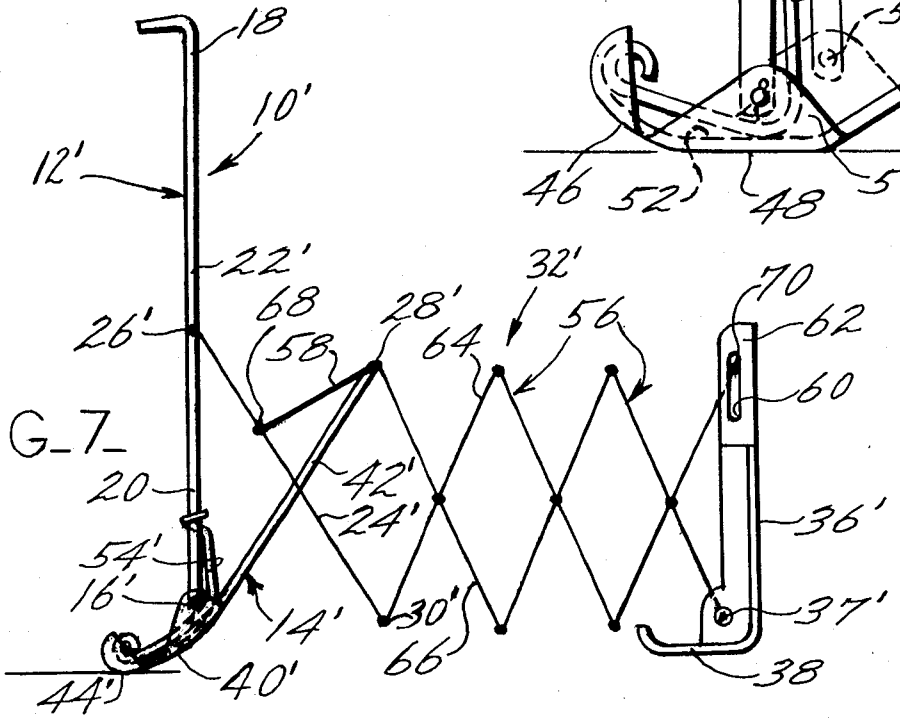
FIG. 7 is a side elevational view of the impelling device with an auxiliary stabilizing link and supplemental scissor linkage used to provide additional vertical stability, strength and reach for the object impacting means.

A second embodiment recreational device 10' shown in FIG. 7 employs a modified stabilizing link 24' and linkage means 32'. These elements, similar in function to the first embodiment, use same identifying numbers with prime indicating association thereto.

An upright shaft 12' continues to support and activate a lever arm 14' that remains pivotally connected thereto by a coupling joint 16'. Arm 14' also includes a heel portion 40', an actuating portion 42', and pivot coupling means 28' at the distal end of arm 14'. Stabilizing link 24' also has its proximal end 26' coupled to the intermediate part 22' of shaft 12' but is now a depending member. The length of link 24' and its distal end pivot coupling means 30' is such or so adapted as to swing in unison with lever arm 14'. With relatively synchronized outward movement of arm 14' and link 24', supplemental linkage assembly 32' can include scissor linkage 56. Linkage 56 can be utilized and made to work by use of an auxiliary "floating" link 58 and a suitable lost-motion slot 60 (see phantom line portion of FIG. 6) in an upright arm 62 on shoe 36'. Additional scissor linkage 56 can be incorporated, if desired, since each set comprises a uniform pair of crossed, centrally pivoted links 64 and 66. Auxiliary stabilizing link 58 has its upper end pivotally joined at 28' to arm 14' and its lower end connected to link 24' at an intermediate point by a pivot joint 68. Coupled in such a manner to arm 14' and link 24', auxiliary link 58 responds quickly to and transfers any movement of arm 14' to link 24'. As link 58 "floats" upwardly, downwardly, inwardly and outwardly with these members (14' and 24') it pulls or pushes on link 24' and keeps its distal joint 30' substantially vertically aligned with joint 28' of arm 14'. With joints 28' and 30' swinging outwardly in unison to compress alternately coupled scissor links 64 and 66, relative angular adjustment of all scissor linkage 56 used acts to increase the effective reach of impelling device 10'. Relative shifting or longitudinal collapsing of linkage 56 during extension is accommodated by the lost or free motion of a scissor link coupling pin 70 within slot 60.

Since this arrangement is basically a "straight-line linkage" it is to be noted this entire linkage (and that of embodiment No. 1) ascends and descends elevationally in conjunction with shaft 12, and 12' during pivotal depression of heel 40, and 40'. Spring 54' used for retracting lever arm 14', on which supplemental scissor linkage 56 is employed, would need to be stronger than those of the first embodiment. The spring acting through arm 14' and auxiliary link 58 applies sufficient downward pressure on stabilizing link 24' to force total retraction of it and shoe 36'.

Ratios and coupling locations used to obtain specific functional characteristics from heel portion 40 and lever actuating portion 42 will now be described more fully.

Size and shape of heel portion 40 (identified as D1) determines directly how actuating portion 42 (identified as D2) of lever arm 14 responds. While the length of heel portion D1 relative to the length of arm D2 is preferably within the range of 1:6–10, the specific rearward angle provided heel portion 40 is most influential.

A small angle or offset from shaft 12 could undesireably require substantial application of force because of relative alignment conditions of parts. Conversely, extreme angling of heel 40 relative to its arm 42 could detrimentally restrict extension of the impelling linkage (arm 14, linkage 32 etc.). A rearward heel angle ranging from 25 to 55 degrees assures with minimum participant effort both speedy extension of the linkage and, a high level of controlled impact force.

Elevating coupling joint 16 of rod 12 on the angularly disposed heel portion 40 inherently increases the differential leverage or mechanical advantage for the downward acting force and thus enhances the devices sensitivity and response. Shifting coupling joint 16 of shaft 12 from heel portion 42 allows application of maximum pressure and fast, full extension of the impelling linkage. As noted previously, flat 48 provided on heel portion 40, once encountered, effectively retards continued rolling or shifting of fulcrum-like arcuate surface 46. The device using a simple arcuate heel, shown in FIG. 4, also has natural retardation of the extension linkage. This retardation occurs when force applied by the participant rolls or shifts the device 10 to a "bottoming out" point when rod 12 is directly perpendicularly above heel coupling joint 16. Any downward force remaining upon shaft 12, after limited rocking, will find its point of equilibrium upon arcuate surface 46 and settle directly aligned with coupling joint 16.

OPERATION

To utilize the subject impelling device, it is held with a firm grip and physically aligned with a movable object or ball. Force is selectively applied to depress shaft 12 and effect controlled rolling or turning of heel 40 and its associated lever portion 42. The force is transferred to linkage assembly 32 which moves shoe 36 outwardly at an accelerating rate due to an increasing lever arm differential. With the FIG. 4 arcuate type heel 40 and coupling joint 16, extension of the linkage is controlled simply by varying the application of force used to depress rod 12.

Use of alternate coupling joint 55 places rod 12 in an overcenter condition relative to lever arm actuating portion 42. This arrangement thus will be very responsive and normally result in full extension of the impelling linkage.

Table-top size and stand-up type impelling devices can use lever arm heel portions 40 ranging 1 CM to 10 CM or more in length to obtain desired motivation of the impelling linkages. All such linkages will respond well, and by experienced, controlled fore and aft tipping of shaft 12 will become easy to manipulate with accuracy and minimum interference. "Built-in" flexibility and resiliency of the thin-section structural linkage will allow circumventing or overriding of difficult to move surface supported objects.

Other aspects, objects, and advantages of this invention can be obtained from a study of the drawings, the disclosure and the appended claims.

I claim:

1. A recreational device (10) for impelling an object forwardly comprisng:

a generally upright shaft (12) having a lower end (20);

a lever arm (14) pivotally connected to the lower end (20) of the shaft (12) at a coupling joint (16) and having a lower rear heel portion (40) and an upper front actuating portion (42);

a stabilizing link (24) pivotally connected to the shaft (12) above the lever arm (14) and extending forwardly from the shaft; and impelling means (32) for urging the object forwardly in the same direction that said stabilizing link extends from said shaft in response to downward movement of the shaft (12) rolling engagement of the heel portion (40) against a surface, and forward and downward swinging movement of the actuating portion (42) of the lever arm (14) about the coupling joint (16), the impelling means (32) being pivotally connected to the stabilizing link (24) and to the lever arm (14) and having a front impact element (36) slideable along the surface and adapted to engage the object.

2. The recreational device (10) of claim 1 wherein the heel portion (40) is located generally longitudinally rearwardly and elevationally below the coupling joint (16).

3. The recreational device (10) of claim 2 including resilient means (54) for retracting the lever arm (14).

4. The recreational device (10) of claim 3 wherein the resilient means (54) includes a spring (54) interacting between the lever arm (14) and the upright shaft (12).

5. The recreational device (10) of claim 1 wherein the heel portion (40) has an arcuately curved surface (46) which serves as a rolling uniform.

6. The recreational device (10) of claim 1 wherein the heel portion (40) includes limiting means (48) for limiting the forward downward swinging movement of the lever arm (14).

7. The recreational device (10) of claim 6 wherein the limiting means (48) is a flat surface.

8. The recreational device (10) of claim 1 wherein the impelling means (32) includes a support arm (34) pivotally connected to the lever arm (14) and the stabilizing link (24), and wherein the impact element (36) is a shoe (36) pivotally connected to the support arm (34).

9. The recreational device of claim 8 wherein the shoe (36) defines a base slide surface (38) having an upwardly curved leading edge (39) and an upwardly curved trailing edge (41).

10. The recreational device (10) of claim 9 wherein said shoe (36) also includes a notched rear center portion (43).

11. The recreational device (10) of claim 1 including a resilient spring (54) adjacent the coupling joint (16) for swingingly moving the actuating portion (42) of the lever arm (14) rearwardly and upwardly to a retracted position.

* * * * *